US005401014A

United States Patent [19]

Okabe et al.

[11] Patent Number: 5,401,014

[45] Date of Patent: Mar. 28, 1995

[54] SHEET FEEDER FOR AN IMAGE FORMING APPARATUS

[75] Inventors: Kouichi Okabe; Satoshi Ise, both of Kanagawa, Japan

[73] Assignee: Fuji Xerox Co., Ltd., Tokyo, Japan

[21] Appl. No.: 72,786

[22] Filed: Jun. 7, 1993

[30] Foreign Application Priority Data

Jun. 8, 1992 [JP] Japan ..... 4-147539

[51] Int. Cl.[6] ..... B65H 9/04; B65H 1/00

[52] U.S. Cl. ..... 271/255; 271/171; 271/164; 271/127

[58] Field of Search ..... 271/9, 127, 162, 164, 271/255, 17

[56] References Cited

U.S. PATENT DOCUMENTS

| | | | |
|---|---|---|---|
| 4,786,042 | 11/1988 | Stemmle | 271/255 X |
| 5,158,276 | 10/1992 | Toma | 271/164 |
| 5,172,903 | 12/1992 | Haneda | 271/171 |
| 5,201,507 | 4/1993 | Tokuda | 271/164 X |
| 5,238,238 | 8/1993 | Shinohara | 271/255 X |

FOREIGN PATENT DOCUMENTS 60-230164 11/1985 Japan .

*Primary Examiner*—H. Grant Skaggs
*Attorney, Agent, or Firm*—Finnegan, Henderson, Farabow, Garrett & Dunner

[57] ABSTRACT

A sheet feeder of the present invention allows a sheet feed cassette having a small capacity and a sheet feed cassette having a large capacity to be installed to a sheet feed unit by making not only members for connection between each sheet feed cassette and the sheet feed unit but also their positional relationship in common.

3 Claims, 7 Drawing Sheets

SHEET FEEDER FOR AN IMAGE FORMING APPARATUS

BACKGROUND OF THE INVENTION

The present invention relates to a sheet feeder used for an image forming apparatus such as a laser printer or an electronic copying machine.

With an image forming apparatus such as a laser printer or an electronic copying machine, cut sheets are set in a sheet containing unit such as a sheet feed cassette or sheet feed tray (hereinafter referred to as "sheet feed cassette"), and the sheet feed cassette is installed in a sheet feeder of the image forming apparatus, so that sheets can be fed one by one using a sheet feed member such as a sheet feed roller arranged in a sheet feed section of the sheet feeder.

In response to a recently increasing demand for using laser printers as printers for word processors and personal computers, an attempt has been made to meet a need for minimizing trouble of sheet shortage by setting a large number of frequently used sheets in the printers. However, such a conventional image forming apparatus requires replenishment of sheets in the course of printing a large number of sheets because the apparatus uses only sheet feed cassettes having a predetermined capacity.

To overcome the problem, sheet feeders capable of receiving not only sheet feed cassettes having a standard capacity but also sheet feed cassettes having a large capacity are proposed in, e.g., Unexamined Japanese Utility Model Publications Nos. 8954/1985 and 59264/1985. Unexamined Japanese Patent Publication No. 230164/1985 discloses an image recording apparatus that designs a sheet feed section as a single sheet feed unit and allows as many sheet feed units to be added to the apparatus body unit as are required.

However, the above-described apparatuses disclosed in Unexamined Japanese Utility Model Publications Nos. 8954/1985 and 59264/1985 have such a structure that a sheet feed cassette is installed to the bottom of the apparatus body. This makes the operation of installing and removing the sheet feed cassette more difficult than the type in which the sheet feed cassette is installed from the side of the apparatus body. In addition, when the sheet feed cassette is replaced with that having a large capacity, the apparatuses additionally require the operations of adjusting the height of a member supporting the apparatus body and replacing such member itself.

Further, an apparatus proposed in Unexamined Japanese Patent Publication No. 230164/1985 can use only sheet feed cassettes having a predetermined capacity (e.g., 250 sheets). Therefore, when a large number of sheets are printed, a new sheet feed cassette must be selected every time the sheets in a sheet feed cassette run out, making the operation troublesome. Still further, the apparatus requires a sheet feed section for each sheet feed cassette, making the apparatus not only mechanically complicated but also economically disadvantageous.

SUMMARY OF THE INVENTION

The present invention has been made in view of the above circumstances involved in conventional apparatuses. Accordingly, an object of the present invention is to provide a sheet feeder allowing sheet feed cassettes having different capacities to be installed thereto without adjustment.

To achieve the above object, the present invention is provided with a sheet feeder that includes a sheet feed section allowing a single sheet feed cassette to be installed thereto. The sheet feed section of the sheet feeder receives a plurality of kinds of sheet feed cassettes interchangeably, each sheet feed cassette having the same width and having a different depth and a different length. To implement such interchangeability, the sheet feed section shares members through which each sheet feed cassette is installed thereto and their positional relationship in common with each sheet feed cassette. Among the plurality of kinds of sheet feed cassettes, a sheet feed cassette having a larger depth as to allow a large number of sheets to be set is installed to the sheet feed section when a large number of sheets are fed, whereas a sheet feed cassette having a smaller depth as to allow only a small number of sheets to be set is installed to the sheet feed section when a smaller number of sheets are fed.

The above-described sheet feeder allows both the shallow sheet feed cassette capable of containing a small number of sheets and the deep sheet feed cassette capable of containing a large number of sheets to be installed to the same sheet feed section. This is an advantage in making a large volume of printing because a sheet feed cassette having a large capacity can be installed to the sheet feeder, which can dispense with the operation of replenishing sheets, selecting a new sheet feed cassette, etc. In addition, when the sheet feed cassette is replaced with that having a large capacity, the operations of adjusting the height of a member supporting the image forming apparatus body and replacing such member are no longer required. Further, a combination of a sheet feed cassette having a small capacity and that having a large capacity can accommodate a larger volume of printing.

DETAILED DESCRIPTION OF THE PREFERRED EMBODIMENT

A sheet feeder, which is an embodiment of the present invention, will now be described in detail with reference to the accompanying drawings. In the embodiment, a sheet feed cassette, a sheet feed section (hereinafter referred to as "sheet feed unit") and various other members involved in the feeding of sheets will collectively be called a sheet feeder.

Figure 1:
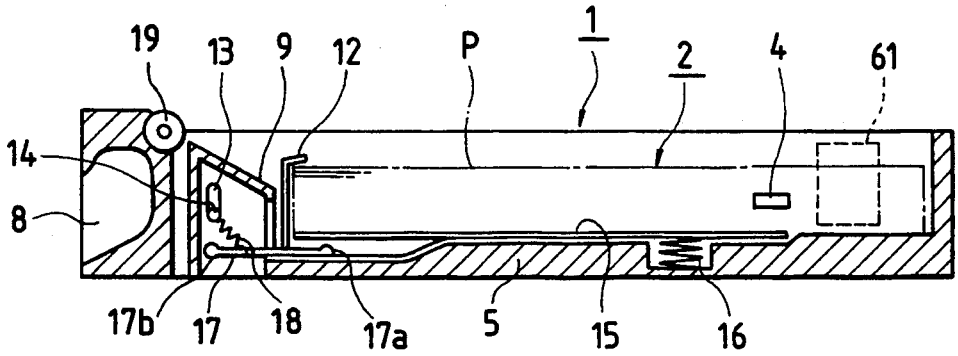
FIG. 1 is a sectional view showing the main portion of a sheet feed cassette having a standard capacity.
Figure 2:
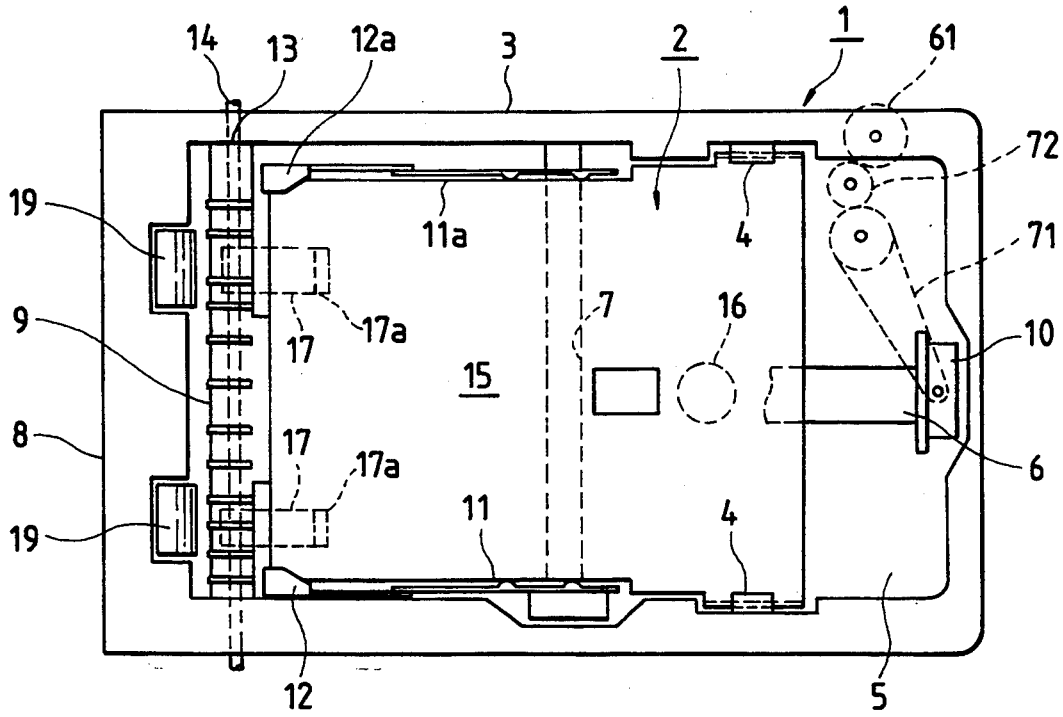
FIG. 2 is a plan view showing the sheet feed cassette having the standard capacity.

First there is described a rough configuration of a sheet feed cassette having a standard capacity used for the sheet feeder of the present invention. FIG. 1 is a sectional view showing the main portion of the sheet feed cassette. FIG. 2 is a plan view thereof. With the sheet feed cassette 1, side frames 3 and a front side guide 9 are arranged so as to surround a sheet containing section 2. A bottom frame 5 is provided below the sheet containing section 2. The bottom frame 5 includes guide rail members 6 and 7 crisscross. Guide members (described later) are movably arranged along the guide rail members 6 and 7. The guide rail member 6 of the bottom frame 5 has an end guide 10 in a sheet feed direction, so that the tail end of a sheet can be regulated by sliding the end guide 10 front and rear. The rail member 7 arranged in a direction orthogonal to the rail member 6 includes side guides 11 and 11*a* for regulating the sides of a sheet. The side guides 11 and 11*a* can be fixedly held at arbitrary positions.

A handle 8 is arranged at a front end of the sheet feed cassette 1, where the front end locates on the sheet feed side (left when viewed in FIG. 1). Front guide 9 is arranged at the handle 8 on the side of the sheet containing section 2, and the front guide 9 has an inclined guide surface. Rollers 19 are arranged so as to confront an end of the inclined guide surface of the front guide 9. FIG. 1 shows a case in which the rollers 19 are integrally arranged with the sheet feed cassette, which the rollers 19 act as pinch rollers of a sheet feed roller unit when the sheet feed cassette is installed to an image forming apparatus as will be described later. Although the roller members are formed integrally with the sheet feed cassette according to the embodiment, the sheet feed roller unit can be arranged inside a body of the image forming apparatus like ordinary sheet feed cassettes.

The sheet containing section 2 of the sheet feed cassette 1 includes a bottom plate 15 for carrying sheets P. The bottom plate 15 does not support only the front end of a sheet on the sheet feed side as a conventional type bottom plate but also has a size enough to carry a sheet slightly smaller than the largest sheet. A spring 16 is arranged at an end of the bottom plate 15 on the side of the end guide 10. Pushing arms 17 are arranged at front end portions in the sheet feed direction as shown in FIG. 1, so that the front side of the bottom plate 15 can be elevated by the pushing arms 17. The rear side of the bottom plate 15 is regulated by stoppers 4 to the limit of elevation thereof, thereby to prevent the rear end of the bottom plate 15 from being loosened out of the sheet containing section 2 by a resilience of the spring 16, even if no sheets are contained therein.

To operate the pushing arms 17, a bar 14 is guided so as to vertically move along a long hole 13 arranged on the side frame 3 in the sheet feed cassette 1. The bar 14 is connected to the pushing arms 17 through springs 18. The pushing arms 17 are pivotably mounted through pivots 17*b*. Pressing portions 17*a* provided at ends of the pushing arms 17 come in contact with the front end of the bottom plate 15.

Figure 3:
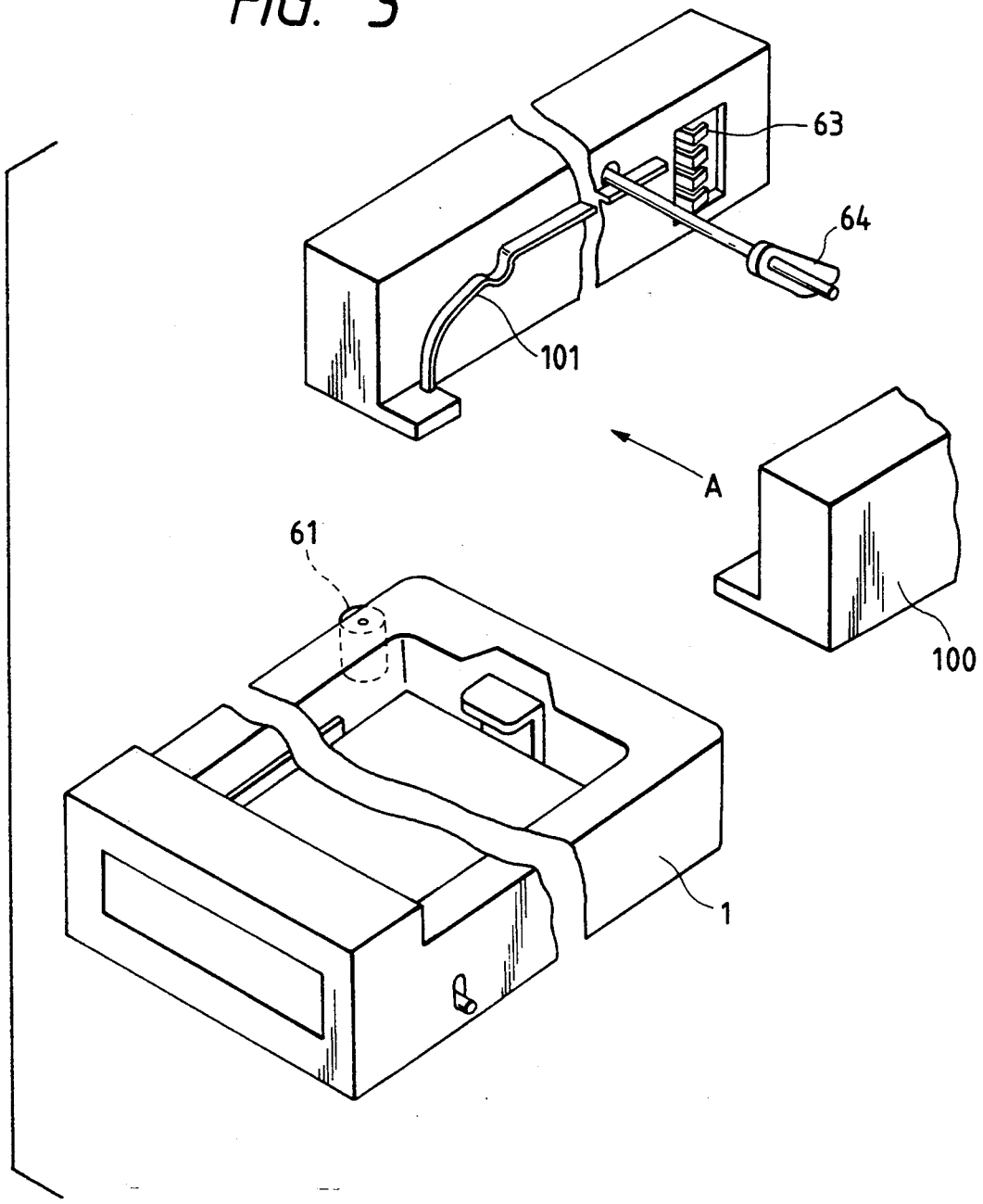
FIG. 3 is a diagram illustrating correspondence between a sheet feed unit and the sheet feed cassette having the standard capacity.
Figure 4:
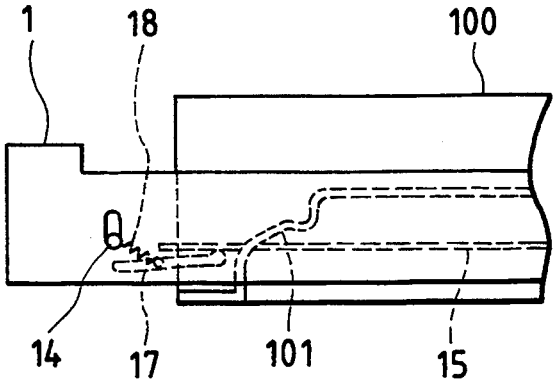
FIG. 4 is a diagram illustrating a movement of an arm when the sheet feed cassette is installed to the sheet feed unit.
Figure 5:
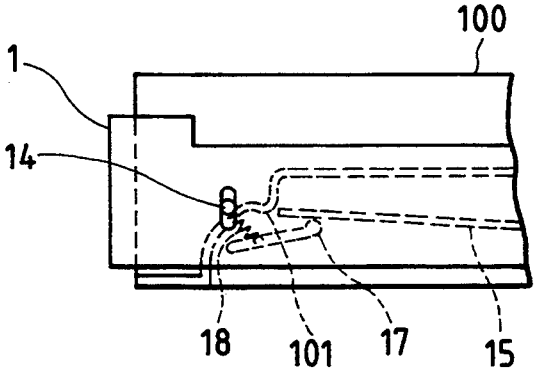
FIG. 5 is a diagram showing a movement of the arm when the sheet feed cassette is installed to the sheet feed unit.
Figure 6:
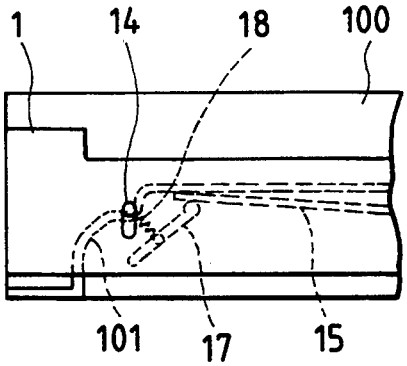
FIG. 6 is a diagram showing a movement of the arm when the sheet feed cassette is installed to the sheet feed unit.

Next, there will be described the operation of installing the sheet feed cassette having the standard capacity to a sheet feed unit on the side of the image forming apparatus. FIG. 3 shows correspondence in location between a sheet feed unit 100 and the sheet feed cassette 1. The pushing arms 17 are operated as shown in FIGS. 4, 5, and 6 when the sheet feed cassette 1 is actually installed to the sheet feed unit 100. FIGS. 4 to 6 partially show states in which the sheet feed cassette 1 is installed to the sheet feed unit 100 as viewed from an arrow A.

At the initial stage of inserting the sheet feed cassette 1 to the sheet feed unit 100 (as shown in FIG. 4), the bar 14 of the sheet feed cassette 1 locates downwardly in the long hole 15. When the sheet feed cassette 1 is further inserted thereafter, the bar 14 rises along guide rails 101 of the sheet feed unit 100 (as shown in FIG. 5). When the sheet feed cassette 1 is completely fitted into the sheet feed unit 100 (as shown in FIG. 6), the bar 14 is completely pushed up by the guide rails 101. At the same time, the springs 18 applies the pushing arms 17 in the direction of elevating thereof. Therefore, the sheet P can be brought into contact with a sheet feed roller (not shown) positioned in the front end of the sheet P under a predetermined pressure while elevating the bottom plate 15 through the pressing portions 17*a* at the ends of the pushing arms 17.

Figure 7:
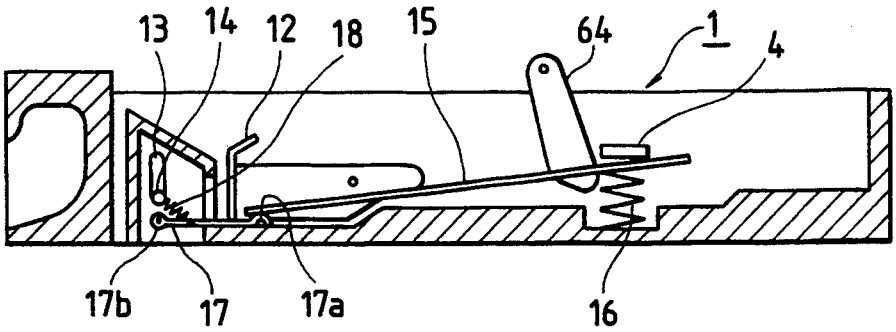
FIG. 7 is a diagram showing the sheet feed cassette having the standard capacity containing no sheets.
Figure 8:
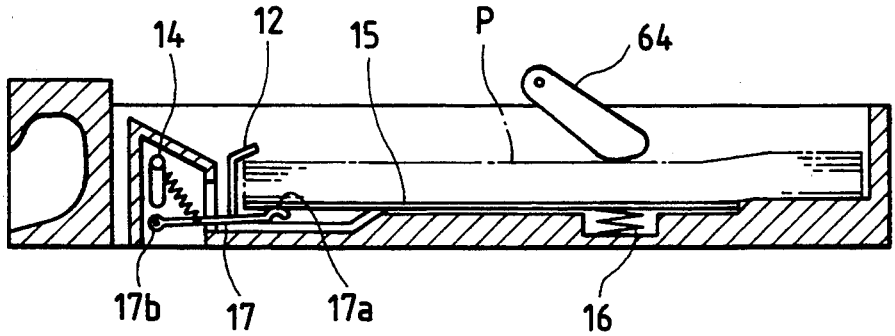
FIG. 8 is a diagram showing the sheet feed cassette having the standard capacity containing a large number of sheets.

With the sheet feed cassette as described above, when sheets are not contained therein, the rear end of the bottom plate 15 is applied by the spring 16 as shown in FIG. 7, and held from elevating by the stoppers 4. The front end of the bottom plate 15 is lower than the rear end thereof because the pushing arms 17 are not operated, thereby to form a slope rising toward the front side. The slope facilitates the operation of inserting the front ends of sheets between snubbers 12, 12*a* and the bottom plate 15 when the sheets are installed to the sheet feed cassette 1. Further, as shown in FIG. 8, if the sheet feed cassette 1 containing a large number of sheets P is installed to the sheet feed unit, then the spring 16 is compressed by the weight of the sheets P, thus the bottom plate 15 is caused to be substantially in parallel with the bottom frame 5. The sheets are fed leftward (as viewed in FIG. 8) under the condition.

Under the condition shown in FIG. 8, when the sheet feed cassette 1 supporting the sheets is inserted into the sheet feed unit 100 of the image forming apparatus, the pushing arms 17 cause the front end of the bottom plate 15 to push up because of the bar 14 elevating as described above. Thus, the sheets P are elevated to a position corresponding to the sheet feed roller (not shown). In accordance with the elevation of the front end of the bottom plate 15, the spring 16 causes the rear end thereof to elevate, so that the sheets are elevated in a substantially parallel condition, and the sheets are set to a sheet feed position.

Figure 9:
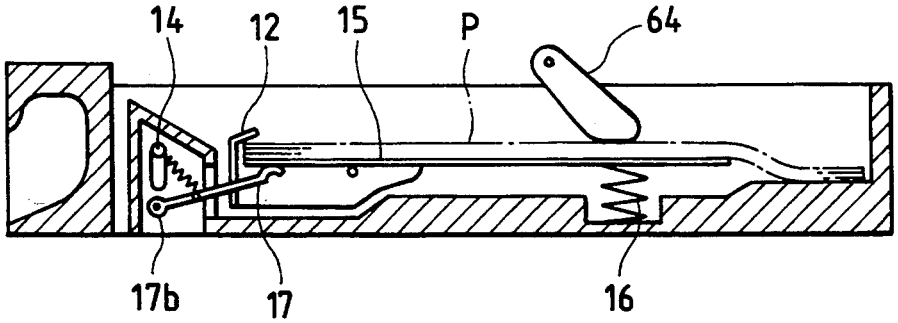
FIG. 9 is a diagram showing the sheet feed cassette having the standard capacity with the sheets decreased.

When the operation of feeding the sheets is continuously performed under the condition shown in FIG. 8, the number of sheets set on the bottom plate 15 is reduced to present a condition shown in FIG. 9. Since the bottom plate 15 maintains the substantially level position under the condition, the position of the front end of each sheet abutting on the sheet feed roller remains unchanged, so that the sheet feed timing is kept to be constant at all times. Therefore, the bottom plate 15 is prevented from inclining, and the sheets can be fed while keeping the sheets substantially horizontal.

There will now be described a mechanism detecting a sheet size of the sheet feed cassette 1. As shown in FIGS. 1 and 2, a user sets sheets in the sheet feed cassette 1, and then positions the end guide 10 to the rear ends of the sheets. At the same time, a sector 71 is rotated in association with the movement of the end guide 10 thereby to cause a size detecting cam 61 to rotate through a coupling gear 72. As shown in FIG. 3, a sheet size detecting member 63 is arranged at a position corresponding to the cam 61 on the side of the sheet feed unit 100. The mechanical size data output from the cam 61 is converted to an electric signal, and the electric signal is transmitted to the apparatus body. A sheet detecting member 64 is attached to the sheet feed unit 100, so that mechanical movement of the sheet detecting member 64 is converted to an electric signal , and then is transmitted to the apparatus body. FIG. 7 shows the position of the sheet detecting member 64 when no sheet is contained, and FIGS. 8 and 9 show the position thereof when the sheets are contained. A sheet cassette variable in sheet size such as the sheet cassette 1 is called a "universal cassette."

Figure 10:
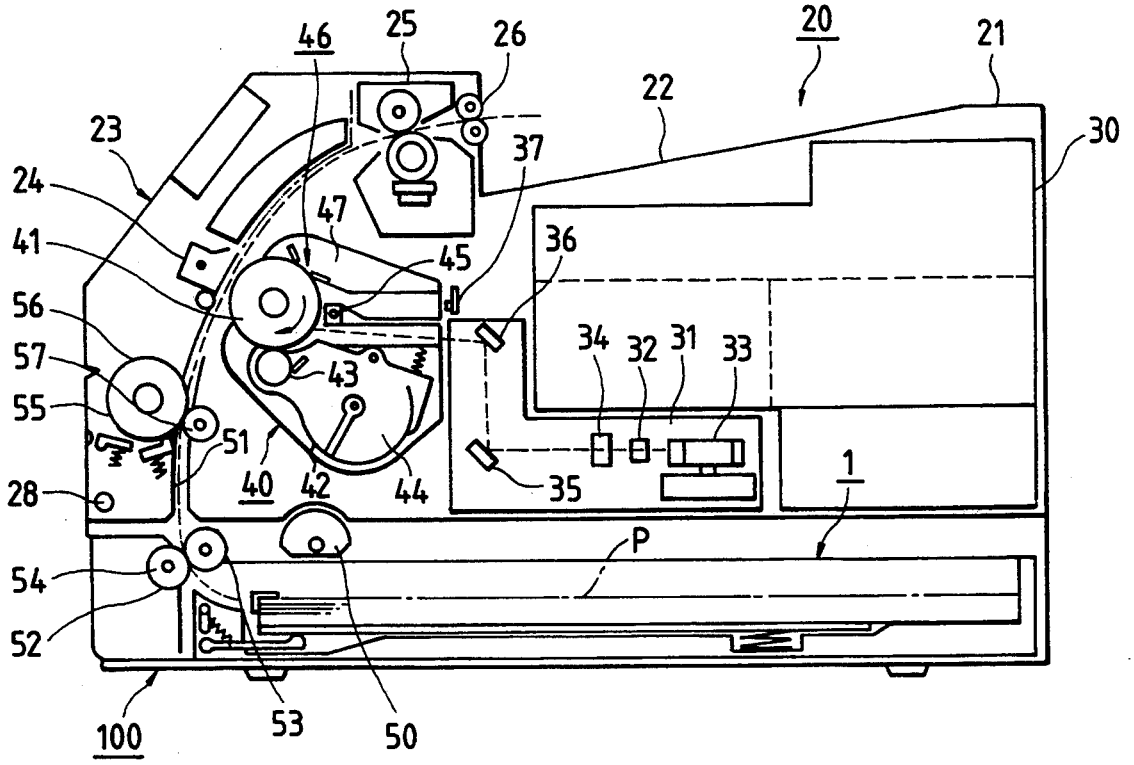
FIG. 10 is a diagram showing a configuration of a laser printer to which the sheet feed cassette of the present invention can be applied.

The above-described sheet feed cassette 1 can be applied to such a laser printer as shown in FIG. 10. The laser printer 20 shown in FIG. 10 is implemented as a small size printer. A front frame 23 of the printer is separable from a body frame 21 through a sheet feed path 51. A sheet discharge tray 22 is disposed above the body frame 21. With the laser printer 20 constructed thus, the body frame 21 includes a control section 30 and an image writing unit 31. Image data are written to a photoreceptor drum 41 by a laser beam output from the image writing unit 31. Similar to those employed in ordinary laser printers, the image writing unit 31 reflects a laser beam generated from a laser oscillator 32 by a polygon mirror 33. The reflected laser beam is transmitted to a f $\theta$ lens 34, and then is irradiated onto the writing section of the photoreceptor drum 41 through a plurality of mirrors 35 and 36, thereby forming a latent electrostatic image on the photoreceptor drum 41.

The photoreceptor drum 41 is provided as a part of an image forming unit 40. In addition to the photoreceptor drum 41, the image forming unit 40 integrally includes a developing unit 42, a cleaning unit 46, and a charge corotron 45. Further, the image forming unit 40 is formed so as to be separable from the body frame 21. Among the components forming the image forming unit 40, the developing unit 42 includes a toner cartridge 44 and a developing roller 43, and employs a device for feeding toner to the developing roller 43 by using a stirring member arranged inside the cartridge. Further, the cleaning unit 46 is designed to clean a surface of the photoreceptor drum 41 by using a blade, and to receive the toner scraped off by the blade into a toner recovering box 47. Still further, the charge corotron 45 is formed integrally with the frame of the image forming unit 40. The charge corotron 45 is designed so that the tension of a corotron wire is applied to the frame of the unit. A section for irradiating a beam from an eraser lamp 37 is arranged above the charge corotron 45 in a rotational direction of the photoreceptor drum 41, so that charges stored on the photoreceptor drum 41 can be discharged before charging the photoreceptor drum 41 by the charge corotron 45.

With the laser printer 20 having the toner image forming device as described above, feed rollers 52 and 55 are arranged along the sheet feed path 51 extending from the sheet feed cassette 1, so that the sheets can be fed along the sheet feed path 51. The front frame 23 constructing the sheet feed path 51 includes a transfer corotron 24 at a position corresponding to the photoreceptor drum 41. A fixing unit 25 and discharge rollers 26 are arranged downstream along the image transfer position, so that a copy having the image fixed thereon by the fixing unit 25 can be discharged toward the sheet discharge tray 22. The laser printer 20 according to the embodiment can be operated by pivoting the front frame 23 along a pivot 28 acting as an axis. Therefore, jamming along the sheet feed path or a replacement of the image forming unit can be dealt with easily by opening the front frame 23.

With the sheet feeder of the laser printer 20, a sheet feed roller 50 arranged in the sheet feed unit 100 for the sheet feed cassette 1 feeds a sheet taken out of the sheet feed cassette 1 by two pairs of feed roller units 52 and 55. The feed roller units 52 and 55 are provided with drive rollers 53 and 56, and pinch rollers 54 and 57, respectively. The rollers 19 shown in FIG. 1 correspond to the pinch rollers 54 shown in FIG. 10.

In the laser printer 20, when an image is written onto the photoreceptor drum 41, a sheet feed command is applied to the sheet feed unit 100 from the control section 30 in such a timing as to allow the front end of the image to come to the photoreceptor drum 41. The sheet feed unit 100 drives the sheet feed roller 50 to feed a sheet P toward the sheet feed path 51. The sheet P is fed along the sheet feed path 51 at a predetermined speed. Under the coincident timing when the sheet reaches the image transfer section, the toner image formed on the photoreceptor drum 41 moves toward the transfer section, and then the toner image is transferred at a predetermined position. Therefore, the laser printer 20 does not involve an inconvenient control method in which the sheet P is temporarily stopped to feed on the way, and then the sheet is started to feed again in coincidence with the toner image formed on the photoreceptor drum. Further, the laser printer 20 allows the sheet to be fed while accurately maintaining the transfer position of the toner image.

With components for holding the sheet in such a manner that the bottom plate is supported in substantially horizontal and moved vertically, the components are not only applied to the universal tray such as indicated in the embodiment, but also to other types of sheet feed cassettes or sheet feed trays containing regular size sheets. In addition to printers, the sheet feed cassette is applicable to the electronic copying machines, which can employ the mechanism of feeding a sheet from the sheet feed cassette to the image transfer section at a predetermined speed without a registration unit.

Figure 11:
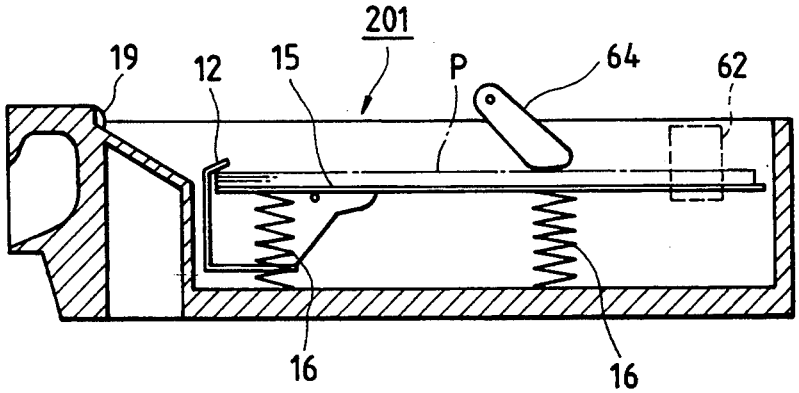
FIG. 11 is a sectional view showing the main portion of a sheet feed cassette having a large capacity.
Figure 12:
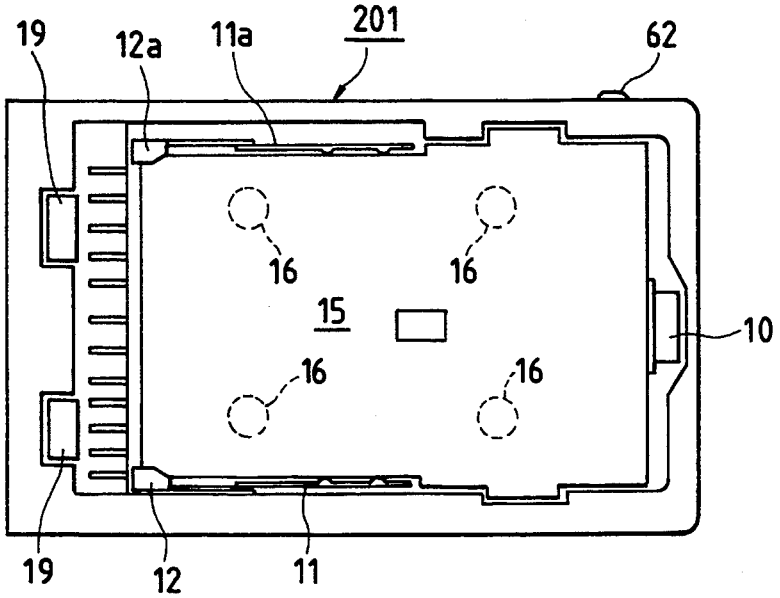
FIG. 12 is a plan view showing the sheet feed cassette having the large capacity.

There will now be described a rough configuration of a sheet feed cassette having a large capacity in the sheet feeder according to another embodiment of the present invention. FIG. 11 is a sectional view showing the main portion of a sheet feed cassette capable of containing 500 sheets, and FIG. 12 is a plan view thereof. A sheet feed cassette 201 is designed so that the position of the end guide 10 is fixed for a specific size (e.g., A4), so that sheets of other sizes cannot be set. Therefore, a projecting portion 62 for transmitting the size of the contained sheet to the apparatus body is arranged instead of the size detecting cam 61 included in the sheet feed cassette 1 shown in FIG. 1. The bottom plate 15 is applied upward by four springs 16 at all times. The push arms 17 and other components for pressing the front end of the bottom plate 15 are not employed in contrast to the sheet feed cassette 1 shown in FIG. 1. A sheet feed cassette whose sheet size is fixed, such as the sheet feed cassette 201, is called a "sheet size fixed cassette."

Figure 13:
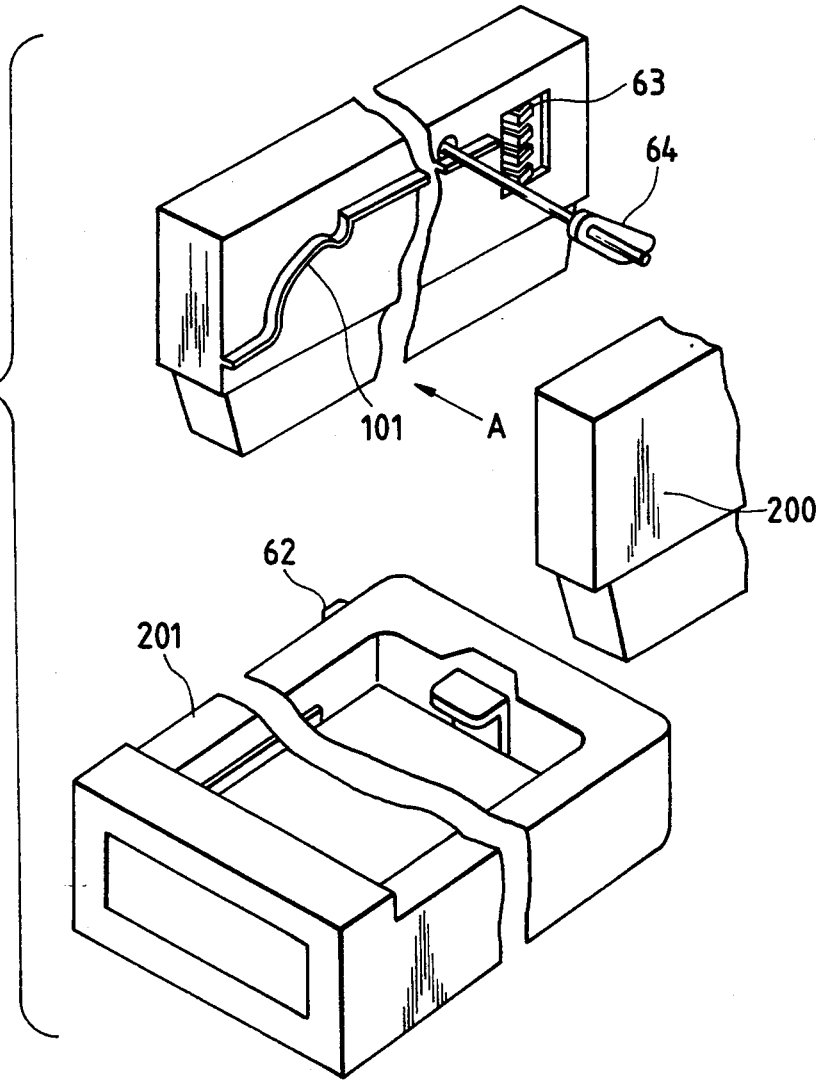
FIG. 13 is a diagram illustrating correspondence between a sheet feed unit and the sheet feed cassette having the large capacity.

The operation of installing the sheet feed cassette 201 to the sheet feed unit of the image forming apparatus body will now be described. FIG. 13 shows correspondence between the sheet feed cassette 201 and the sheet feed unit 200 for installing the cassette. The sheet feed unit 200, like the sheet feed unit 100 shown in FIG. 3, includes a sheet size detecting member 63, a sheet detecting member 64, a driven member (not shown), and guide rails 101. These components are arranged at positions corresponding to the sheet feed unit 100 shown in FIG. 3. That is, in comparison with the sheet feed unit 100 for the sheet feed cassette 1 having the standard capacity shown in FIG. 3 and the sheet feed unit 200 for the sheet feed cassette 201 having the large capacity shown in FIG. 13, both units are designed to have the same positional relationship as to the sheet size detecting member 63, sheet detecting member 64, driven member (not shown), and guide rails 101. Further, as a comparison between the sheet feed cassette 1 having the standard capacity shown in FIG. 1 and the sheet feed cassette 201 having the large capacity shown in FIG. 11, both cassettes are designed to have the same positional relationship as to the size detecting cam 61 corresponding to the sheet size detecting member 63 of the sheet feed unit as well as the projecting portion 62, and the same operational position as to the sheet detecting member 64. Therefore, exactly the same sheet feed operation can be performed by the apparatus body either in the case where 250 A4-size sheets are set to the sheet feed cassette 1 having the standard capacity, or in the case where 500 A4-size sheets are set to the sheet feed cassette 201 having the large capacity.

According to the embodiment, a universal cassette is used as the sheet feed cassette having the standard capacity, and a sheet size fixed cassette is used as the sheet feed cassette having the large capacity. Further, the sheet feed cassette having the standard capacity may be replaced by a sheet size fixed cassette having the projecting portion 62 for transmitting the size data. Moreover, the sheet feed cassette having the large capacity may be replaced by a universal cassette having the size detecting cam 61.

We now describe specific examples in which the sheet feed cassette is used in the image forming apparatus having the sheet feed unit 100 shown in FIG. 3 and the sheet feed unit 200 shown in FIG. 13 as follows.

Figure 14:
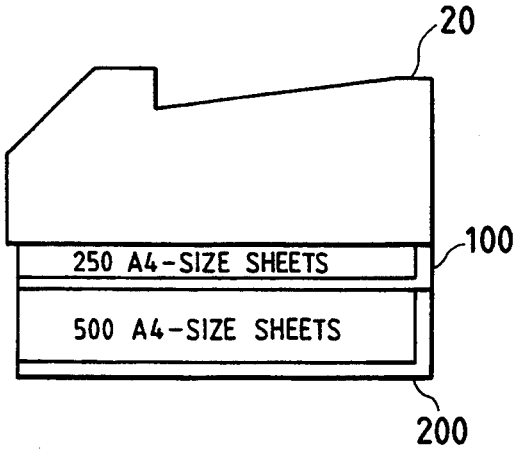
FIG. 14 is a diagram illustrating a combination of the sheet feed unit for the sheet feed cassette having the standard capacity and the sheet feed unit for the sheet feed cassette having the large capacity.

FIG. 14 shows an example in which the sheet feed unit for the standard capacity cassette is installed to the first step (upper side) and the sheet feed unit for the large capacity cassette is installed to the second step (lower side). In the example shown in FIG. 14, 250 A4-size sheets are set to the sheet feed cassette in the first step, whereas 500 A4-size sheets are set to the sheet feed cassette in the second step. This example shows a case where printing is performed only on A4-size sheets in large amounts. A total of 750 sheets can be printed continuously without having to replenish sheets or to replace a new sheet feed cassette every 250 sheets. Further, the operation of adjusting the height of a member supporting the apparatus body or replacing such member itself is not required even if the sheet feed cassette having the large capacity is installed.

Figure 15:
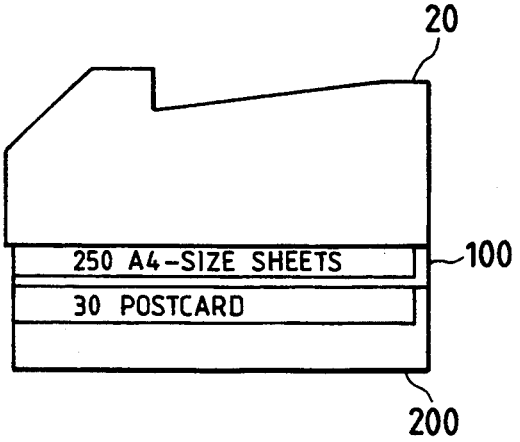
FIG. 15 is a diagram illustrating a different combination of sheet feed cassettes with the same sheet feed unit configuration as shown in FIG. 14.

FIG. 15 shows a different combination in sheet type between sheet feed cassettes adapted to the same configuration as the sheet feed unit shown in FIG. 14. That is, 250 A4-size sheets are set to the sheet feed cassette positioned at the first step and 30 postcards are set to the sheet feed cassette positioned at the second step. Although many conventional printers are designed to feed ordinary sheets by the cassette and postcards by the manual installation, according to this embodiment, the postcards can be fed by the cassette without changing any sheet feed unit. Moreover, a cassette capacity smaller than 250 sheets is adequate for feeding the postcards.

Figure 16:
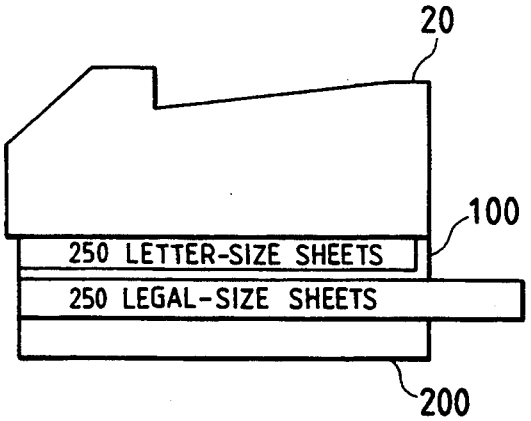
FIG. 16 is a diagram illustrating a combination of sheet feed cassettes whose lengths are different with the same sheet feed unit configuration as shown in FIG. 14.

FIG. 16 shows a different combination in length between sheet feed cassettes adapted to the same configuration of the sheet feed unit as shown in FIG. 14. That is, 250 letter-size sheets are set to the sheet feed cassette positioned at the first step, and 250 legal-size sheets are set to the sheet feed cassette positioned at the second step. According to this embodiment, the same sheet feed unit can receive two sheet feed cassettes whose lengths are different from each other.

While the sheet feed unit for the standard capacity cassette and the sheet feed unit for the large capacity cassette are arranged at the first and second steps as shown in FIGS. 14 to 16, the present invention can be applied to different configurations as well. For example, only sheet feed units for the large capacity cassette may be used. Reversely, the sheet feed cassette having the standard capacity is arranged at the second step and that having the large capacity is arranged at the first step. Such a combination or vice versa may also be applicable.

Further, a sheet feed cassette having a smaller capacity than the standard capacity (smaller than 250 sheets) may be installed to the sheet feed unit. Correspondence between the sheet size detecting member and the like can be shared in common with the sheet feed cassette having the standard capacity even in such a case.

As described above, the sheet feeder of the present invention is characterized as making the components for connection between the sheet feed cassettes and the sheet feed units and their positional relationship in common, so that a single sheet feed unit can accommodate each of the sheet feed cassette having the standard capacity and the sheet feed cassette having the large capacity. Therefore, if the sheet feed unit of the large capacity is installed to the apparatus body, both the sheet feed cassette of the standard capacity as well as the sheet feed cassette of the large capacity can be installed without adjustment. As a result, the need for a large volume of printing called for laser printers can be met with ease.

Although the sheet feed section is consistently called the sheet feed unit as described above, the sheet feed section may be called a "sheet feed station." The sheet feed station can have a similar function to the sheet feed unit.

What is claimed is:

1. A sheet feeder for an image forming apparatus comprising:

a sheet feed cassette setting sheets therein, said sheet feed cassette including means for transmitting size data of said sheets to said image forming apparatus, and said sheet feed cassette being adjustable in depth and length to provide a plurality of configurations adapted to a plurality of filling numbers and a plurality of sizes of said sheets; and a sheet feed station allowing said sheet feed cassette to be installed thereto interchangeably, and said sheet feed station includes a sheet detecting member attached thereto and a sheet size detecting member arranged at a position corresponding to said transmitting means of said sheet feed cassette, wherein said sheet feed cassette has a positional relationship as to said sheet detecting member and sheet size detecting member of said sheet feed station that remains the same for each of said plurality of configurations and further includes a bottom plate for carrying said sheets, pushing arms pivotably mounted at front end portions thereof in a sheet feed direction for elevating said bottom plate, a spring connecting to said pushing arms and applying said pushing arms in a direction of elevating thereof, an oblong hole arranged on the side of said sheet feed cassette, and a bar guided so as to vertically move along said oblong hole and connected to said pushing arms through said springs.

2. The sheet feeder of claim 1, wherein said sheet feed station further includes guide rails for raising said bar of said sheet feed cassette, and said sheet feed cassette has the same positional relationship to said guide rails for each of the plurality of configurations of said sheet feed cassette.

3. The sheet feeder of claim 1, further comprising at least one spring coupled to said bottom plate at a position remote from said pushing arms to elevate said bottom plate to any of a plurality of essentially parallel positions.

* * * * *